United States Patent [19]

Nakamura et al.

[11] 4,367,708

[45] Jan. 11, 1983

[54] SYSTEM FOR REGULATING THE ENGINE SPEED

[75] Inventors: Hiroyuki Nakamura, Higashiyamato; Makoto Shikata, Musashimurayama; Masaaki Ohgami, Musashino, all of Japan

[73] Assignees: Fuji Jukogyo Kabushiki Kaisha, Tokyo; Nissan Motor Co., Ltd., Yokohama, both of Japan

[21] Appl. No.: 240,689

[22] Filed: Mar. 5, 1981

[30] Foreign Application Priority Data

Mar. 7, 1980 [JP] Japan ..... 55-29334

[51] Int. Cl.[3] ..... F02D 9/02

[52] U.S. Cl. ..... 123/339; 123/361

[58] Field of Search ..... 123/339, 361, 352, 353, 123/354

[56] References Cited

U.S. PATENT DOCUMENTS

| | | | |
|---|---|---|---|
| 4,212,272 | 7/1980 | Hawk | 123/339 |
| 4,245,599 | 1/1981 | Des Lauriers | 123/361 X |
| 4,289,100 | 9/1981 | Kinugawa et al. | 123/339 |
| 4,304,201 | 12/1981 | Bleeke | 123/339 |

*Primary Examiner*—Tony M. Argenbright
*Attorney, Agent, or Firm*—Martin A. Farber

[57] ABSTRACT

A system for regulating the engine speed of an internal combustion engine having a carburetor and a throttle valve in the carburetor. The system comprises an electro-mechanical actuator having a push rod engaged with a throttle lever for maintaining the throttle valve to an open state, a speed sensor for detecting the speed of engine, and an electronic control circuit. The electronic control circuit comprises a comparing circuit connected to the speed sensor, a level setting circuit for applying a standard level to the comparing circuit for comparing the output of the speed sensor with the standard level, and a control circuit for producing a pair of output signals for a time period in dependency on the output of the comparing circuit. Output signals of the control circuit are applied to a driving circuit for driving the electro-mechanical actuator for projecting or retracting the push rod, so that throttle valve is opened or closed in dependency on the output signals of the speed sensor for controlling the engine speed to the standard level.

8 Claims, 9 Drawing Figures

| mode | car speed | engine speed | ignition switch | contact switch |
|---|---|---|---|---|
| 1 | 0 | 0 | OFF | OFF |
| 2 | 0 | 0 | ON | OFF OR ON |
| 3 | 0 | 0 | ON | OFF |
| 4 | 0 | $n_1$ | ON | OFF ⇩ ON |
| 5 | 0 | $n_1$ | ON | ON |
| 6 | over 0 | $n_2$ | ON | ON ⇩ OFF |
| 7 | over 0 | over $n_3$ | ON | OFF |
| 8 | over 0 | $n_2$ | ON | OFF ⇩ ON |
| 9 | over 0 | over $n_3$ | ON | OFF ⇩ ON |
| 10 | 0 | over $n_1$ | ON | ON |
| 11 | over 0 | $n_1$ | ON | OFF ⇩ ON |
| 12 | 0 | below $n_1$ | ON ⇩ OFF | ON ⇩ OFF |

SYSTEM FOR REGULATING THE ENGINE SPEED

BACKGROUND OF THE INVENTION

The present invention relates to a system for automatically regulating the engine speed of an internal combustion engine for automobiles, and more particularly to a system for regulating the idling speed.

The idling speed of the engine is initially regulated to a predetermined set speed in the manufacturing shop. Thereafter, th idling speed increases gradually, because the friction of the engine decreases as the mileage of the automobile increases. Therefore, the idling speed must be regulated to the set speed by operating the regulating screw according to the variation of the idling speed.

SUMMARY OF THE INVENTION

An object of the present invention is to provide a system which automatically regulates the idling speed to a predetermined set speed.

Another object of the present invention is to provide a system for automatically regulating the idling speed which may also have effects of the throttle opener and the dash pot.

According to the present invention, there is provided a system for regulating the engine speed of an internal combustion engine having a carburetor and a throttle valve in the carburetor, comprising an electro-mechanical actuator for maintaining the throttle valve to an open state, a speed sensor for detecting the speed of the engine, comparing circuit means connected to the speed sensor, setting circuit means for applying a standard level to the comparing circuit means for comparing the output of the speed sensor with the standard level, control circuit means for producing a pair of output signals for a time period in dependency on the output of the comparing circuit means, and driving circuit means for driving said electromechanical actuator for increasing and decreasing the open state of the throttle valve in dependency on the output signals of the control circuit means.

Other objects and features of the present invention will become apparent from the following description with reference to the accompanying drawings.

DETAILED DESCRIPTION OF THE PREFERRED EMBODIMENTS

Figure 1:
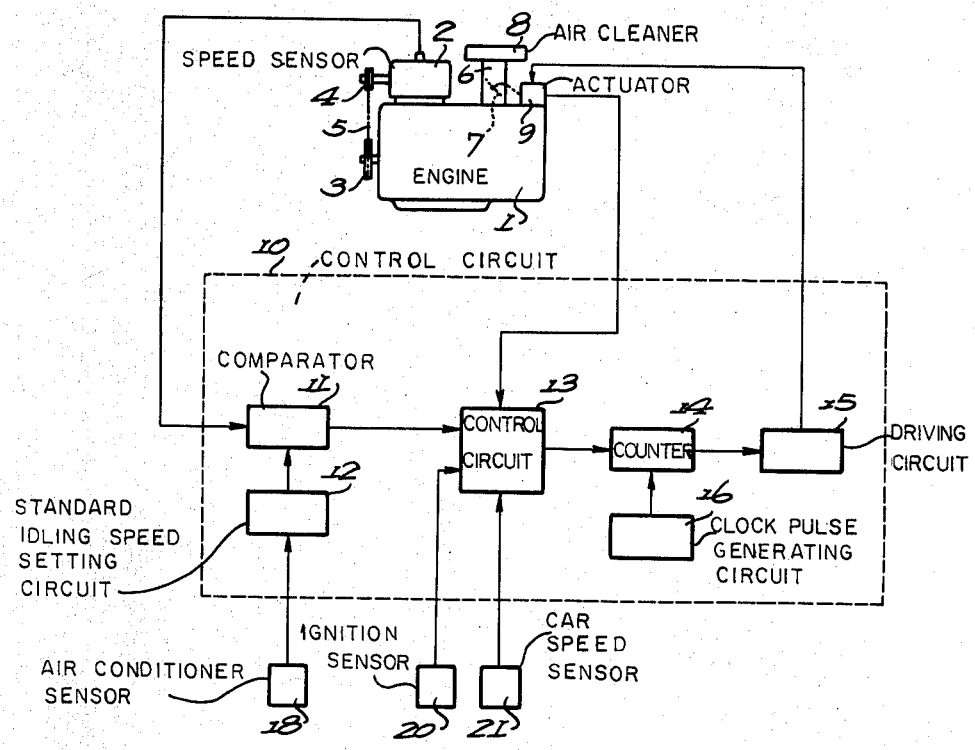
FIG. 1 is a block diagram showing a system of the present invention.

Referring to FIG. 1, an internal combustion engine 1 is provided with a speed sensor 2 which is connected to the crank shaft of the engine by pulleys 3 and 4 and a belt 5. A carburetor 6 has a throttle valve 7 and an air cleaner 8. The shaft of the throttle valve 7 is adapted to be operated by an actuator 9. The output terminal of the speed sensor 2 is connected to a comparator 11 of a control circuit 10.

A standard idling speed setting circuit 12 is connected to the comparator 11 for comparing the idling speed with the standard idling speed. The comparator 11 is connected to a control circuit 13 which is in turn connected to a driving circuit 15 through a counter 14 for driving the actuator 9 in dependency on the signal from the speed sensor. A clock pulse generating circuit 16 is connected to the counter 14.

An air-conditioner sensor 18 for detecting the operation of the air-conditioner is connected to the standard idling speed setting circuit 12. An ignition sensor 20 and a car speed sensor 21 are connected to the control circuit 13.

Figure 2:
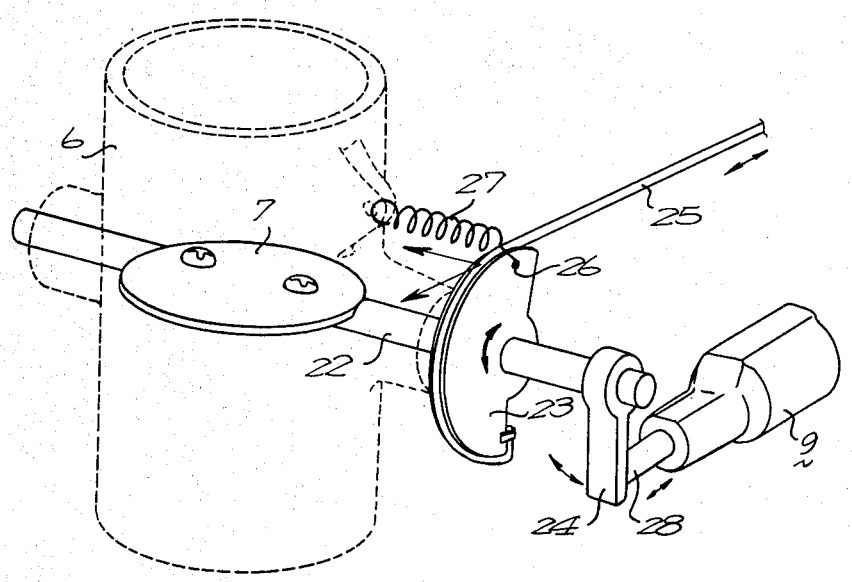
FIG. 2 is a perspective view showing an actuator and a carburetor.

Referring to FIG. 2, throttle levers 23 and 24 are secured to the shaft 22 of the throttle valve 7. The throttle lever 23 is connected to an accelerator pedal through an accelerator cable 25 and biased by a spring 27 connected between a hole 26 and the carburetor body so as to close the throttle valve 7. The lever 24 abuts on the end of a rod 28 of the actuator 9.

Figure 3:
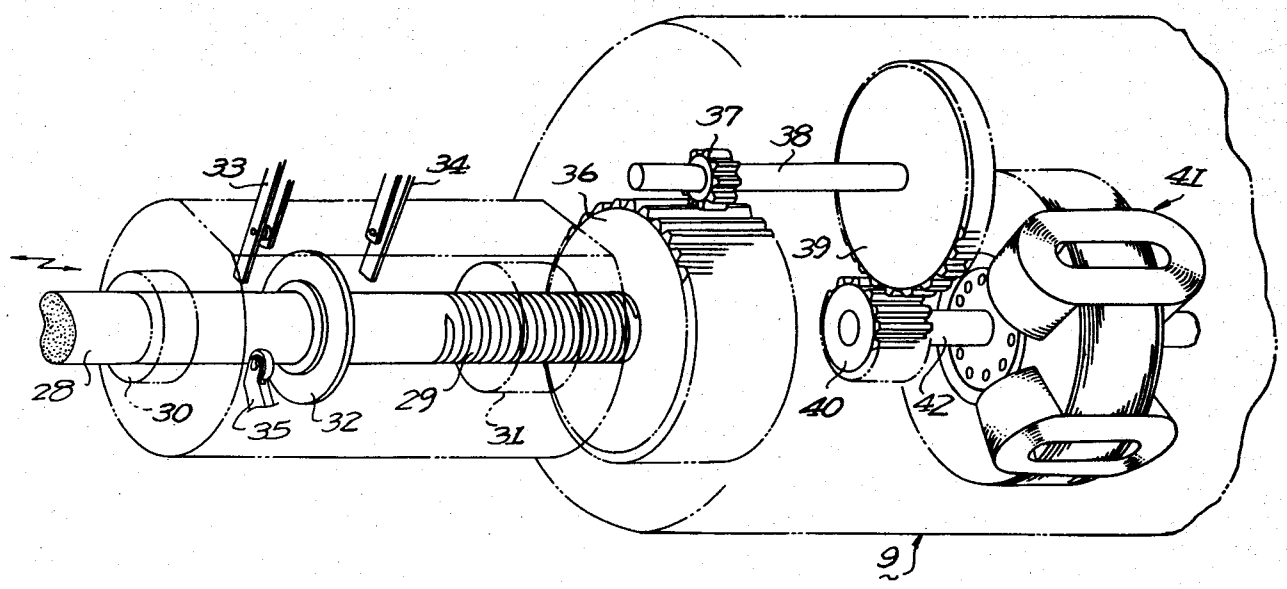
FIG. 3 is a perspective view showing the actuator in detail.

As shown in FIG. 3, the rod 28 is secured to a gear 36 and supported by a bearing 30. The rod 28 has an actuating plate 32 and a screw portion 29 which is threaded into a stationary fixed nut 31. A pair of limit switches 33 and 34 are provided on opposite sides of the plate 32. A feeder roller 35 is engaged with the rod 28 to feed a current. The gear 36 is made of plastics and the rod 28 is insulated from the housing. Accordingly, when the rod 28 is in contact with the lever 24, the current flows through the rod 28 and lever 24, so that the contact may be electrically detected. The gear 36 engages with a small gear 37 secured to a shaft 38 of a large gear 39. The gear 39 engages with a small gear 40 secured to a shaft 42 of a motor 41.

The motor 41 operates to rotate the shaft 42 in one direction or in the opposite direction according to signals which will be hereinafter described. The rotation of the shaft 42 is transmitted to the rod 28 through gears 40, 39, 37 and 36. The gear 36 always engages the gear 37 since the gear 36 is sufficiently enlarged. The rod 28 moves in the axial direction because of the engagement of the screw portion 29 with the nut 31. Thus, the rod 28 projects or retracts by signals. Projection of the rod 28 causes the shaft 22 of the throttle valve to rotate in the throttle valve open direction. Thus, the engine speed increases. To the contrary, when the rod is retracted, the throttle valve 7 is closed by the spring 27, so that the engine speed decreases.

The plate 32 of the rod 28 actuates to open the limit switch 33 or 34 at the limit stroke end, which means the limitation of the operation of the throttle valve for the idling speed. The switch 32 and 33 are provided in a motor driving circuit. Accordingly, the motor stops on the opening of one of the switches and the operation of the throttle valve stops.

Figure 4:
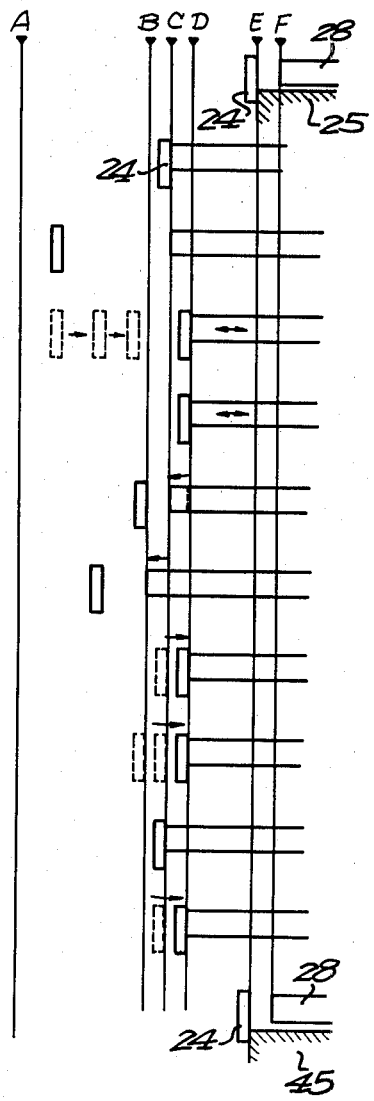
FIG. 4 is a chart showing an operation of the actuator.
Figure 8A:
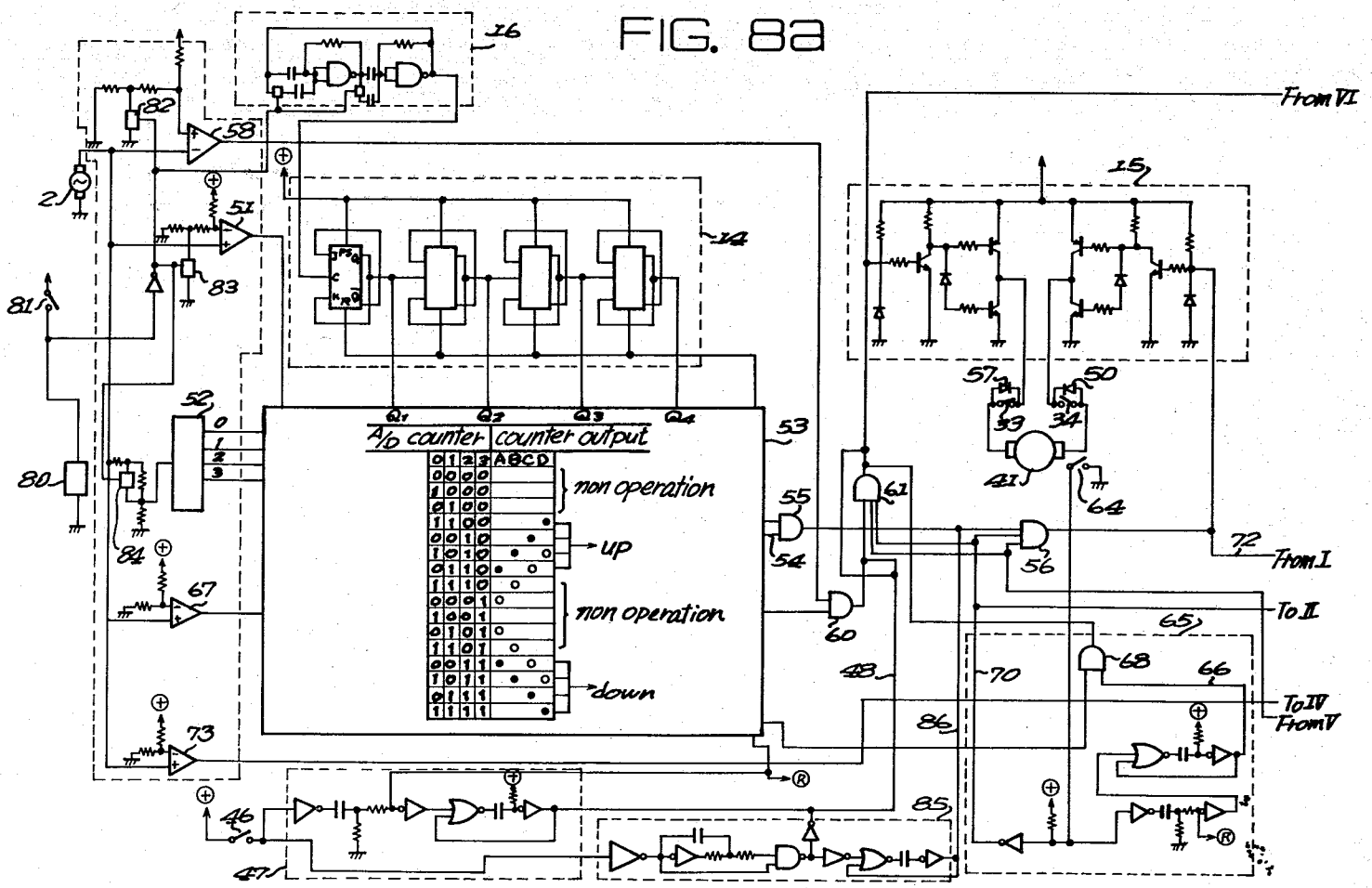
FIGS. 8*a* and 8*b* show an example of the control circuit in the system of the present invention.
Figure 8B:
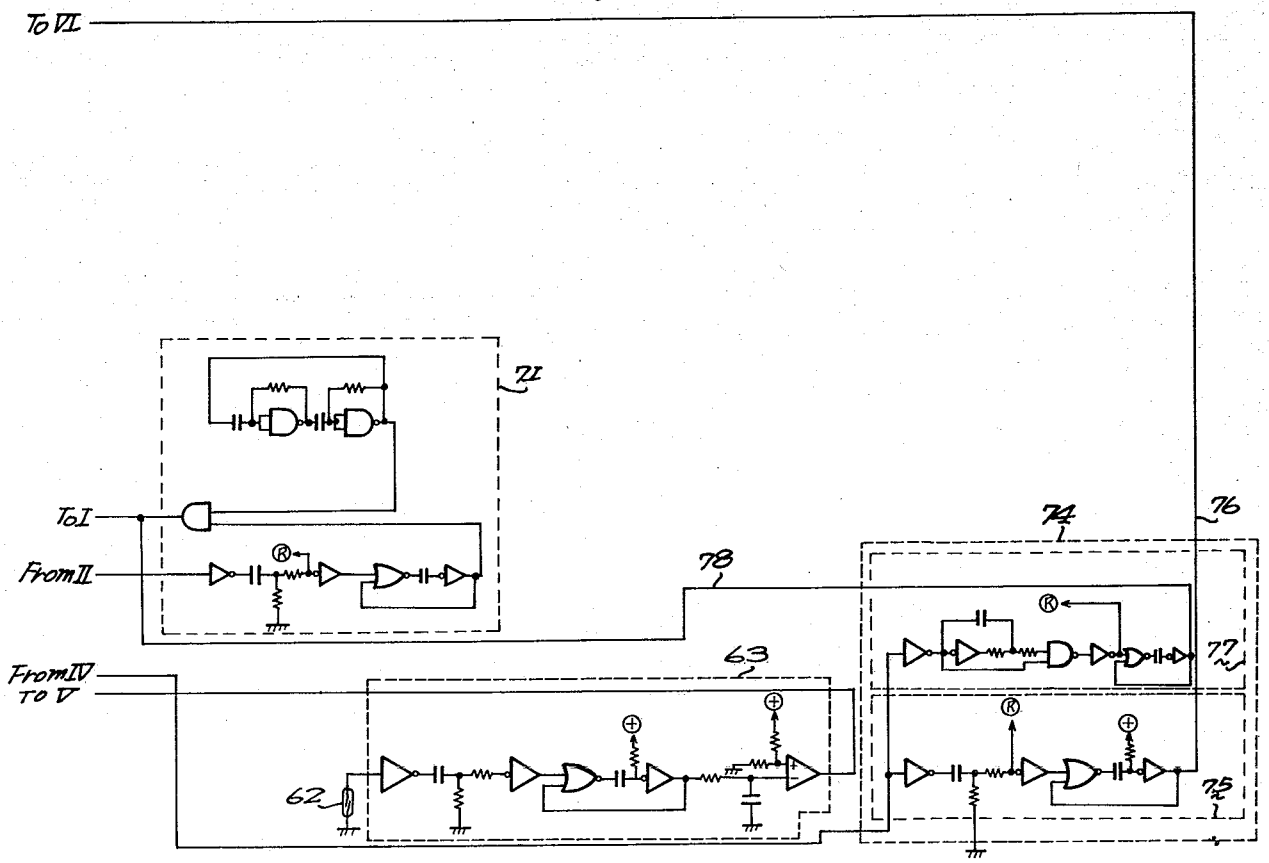

The operation of the system will be hereinafter described with reference to FIGS. 4, 8*a* and 8*b*. When an ignition switch 46 (FIG. 8*a*) is opened, the rod 28 of the actuator 9 is in the retracted position F and the throttle lever 24 abuts on a stopper 45 as shown in FIG. 4. The limit switch 34 is opened by the plate 32. When the ignition switch 46 is closed, a starting circuit 47 operates to produce an output signal for a predetermined time.

The signal is applied to the driving circuit 15 by a lead 48 to operate the circuit. A driving current flows through the switch 33, motor 41 and diode 50, so that the motor 41 rotates to project the rod 28. As shown in FIG. 4 at modes 2 and 3, the rod 28 is projected to a position C which is over a normal idling position D, whereby the throttle valve 7 is opened greater than the normal idling opening degree for starting the engine. The mode 3 shows the cold engine start condition where choke valve is closed. Since the throttle valve is opened according to the closing of the choke valve, the lever 24 is apart from the rod 28.

When the engine speed is higher than a predetermined rate $n_1$ in the stopping condition of the car, the output voltage of the speed sensor 2 exceeds a predetermined standard level, so that the output of a comparator 51 changes to a high level. The output is applied to an AND gate 55. On the other hand, the output of the speed sensor 2 is converted to digital signals by an A/D converter 52 in dependency on the output voltage. Outputs of the A/D converter 52 is applied to a logic circuit 53 having the operation of the truth table. The counter 14 counts pulses from the clock pulse generating circuit 16 to produce time signals $Q_1$, $Q_2$, $Q_3$ and $Q_4$ which have different time periods respectively. The time signals $Q_1$ to $Q_4$ are applied to gates in the logic circuit 53 for opening the gates for the respective time period. The logic circuit 53 operates to change the output signal on a lead 54 to a 1 for a time period which is decided by the outputs of the A/D converter 52, that is the idling speed of the engine. Thus, the output of the AND gate 55 goes to a high level which is applied to the driving circuit 15 through an AND gate 56. The driving current flows through the switch 34, motor 41 and diode 57, so that the motor 41 rotates reversely. Thus, the rod 28 is retracted for the time period, thereby to decrease the idling speed to the standard idling speed $n_1$.

If the idling speed is lower than the idling speed $n_1$, the output of a comparator 58 changes to a high level which is applied to an AND gate 60. The output of the AND gate 60 changes to a 1 for a predetermined time by signals from the logic circuit 53 and comparator 58 in a manner similar to the above described operation. The output of the AND gate 60 is applied to the driving circuit 15 through an AND gate 61. Thus, the motor 41 rotates to project the rod 28, so that the idling speed may be controlled to the idling speed $n_1$.

Modes 4 and 5 show such control operations. In the mode 4, the lever 24 rotated together with the choke valve is gradually returned to the position D as the warming up of the engine progresses.

When the car is started and the output of a car speed sensor 62 exceeds a predetermined level, the output of a car speed detecting circuit 63 changes to 0 for a predetermined time thereby to close AND gates 56 and 61. When the throttle valve 7 is opened, the lever 24 separates from the rod 28. Thus, the contact switch 64 composed by the roller 35, rod 28 and lever 24 is opened. The contact switch 64 is connected to a rod projecting circuit 65 for the dash pot. The output on lead 66 of the circuit 65 goes to a high level for a predetermined time by the signal of the switch 64. When the engine speed exceeds a predetermined speed $n_2$, an output of a comparator 67 changes to a high level. Thus, the output of an AND gate 68 goes to a high level, so that the motor 41 is operated to project the rod 28 to the middle position C. Mode 6 shows this operation.

Figure 6:
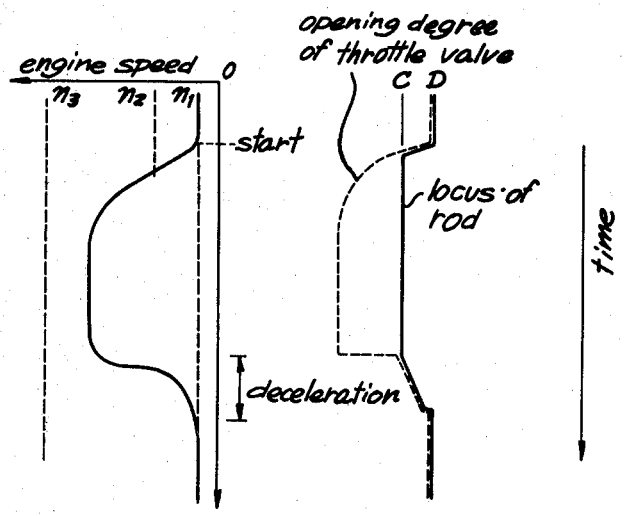
FIGS. 6 and 7 are graphs showing relations between a rod of the actuator, throttle valve and engine speed.

When the throttle valve 7 is closed for deceleration of the car, the lever 24 abuts on the rod 28 thereby to close the contact switch 64. Accordingly, output on a lead 70 changes to a high level, which is applied to a rod retracting circuit 71 for the dash pot. The circuit 71 produces an intermittent output on a lead 72 for a predetermined time. The motor 41 is intermittently operated, so that the rod 28 is slowly retracted to the position D. Thus, dash pot effect may be provided. Mode 8 of FIG. 4 and FIG. 6 show the dash pot operation.

Figure 7:
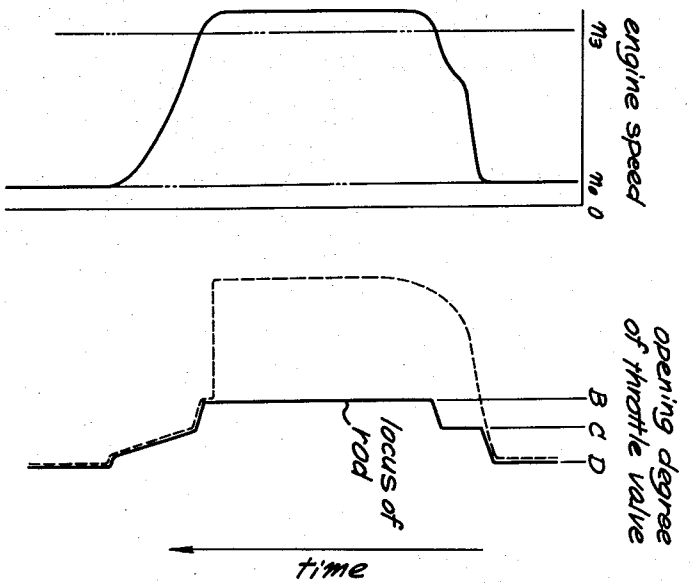

When the engine speed exceeds a predetermined speed $n_3$, an output of a comparator 73 changes to a high level, which is applied to a throttle opener control circuit 74. A rod projecting circuit 75 operates to generate an output signal for a predetermined time. The output signal is applied to the driving circuit 15 by a lead 76. Thus, the rod 28 is projected to the position B as shown at mode 7 in FIG. 4. When the engine speed decreases below the speed $n_3$, the output of the comparator 73 is inverted. By such an inversion of the output, a rod retracting circuit 77 of the throttle opener control circuit 74 operates to produce an output for a predetermined time. The output is applied to the driving circuit 15 by leads 78 and 72. Accordingly, the rod 28 is retracted to the position C. Thereafter, by the signal of the contact switch 64, the rod retracting circuit 71 operates to retract slowly the rod 28 to the position D as described above. Mode 9 and FIG. 7 show such a throttle opener effect.

Figure 5:
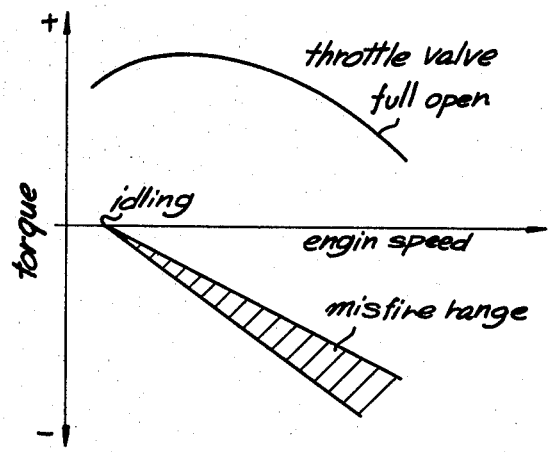
FIG. 5 is a graph showing a range of misfire of an engine.

The throttle opener effects to prevent the misfire of the engine. The misfire occurs in the negative torque condition of the engine, such a condition as the throttle valve is closed on the descent. FIG. 5 shows the range in which the misfire will occur. Since the throttle opener keeps the throttle valve in an open condition for a predetermined time at the deceleration, the misfire may be prevented.

Now hereinafter describing the operation for the air-conditioner, an air-conditioner 80 is operated by closing an air-conditioner switch 81. By closing the switch 81, semiconductor switches 82, 83 and 84 are closed, so that each set value of comparators 51, 58 and A/D converter 52 is raised. Therefore, the motor 41 is operated to project the rod 28 so as to increase the idling speed to the raised level. When the switch 81 is opened, the rod 28 is retracted to the position D. Modes 10 and 11 show such an operation.

When the ignition switch 46 is opened, a run-on preventing circuit 85 operates to produce an output, which is applied to the AND gate 56 by a lead 86. The output of the AND gate actuates the driving circuit 15, so that the rod 28 is further retracted to the initial position F as shown in mode 12. The lever 24 abuts on the stopper 45. Since the rod 28 is separated from the lever 24 and the lever abuts on the stopper, the throttle valve is kept in the closed position. Thus, the run-on of the engine may be prevented.

What is claimed is:

1. A system for regulating the engine speed of an internal combustion engine having a carburetor and a throttle valve in said carburetor, comprising:

an electro-mechanical actuator for maintaining said throttle valve to an open state, a speed sensor for detecting the speed of said engine, comparing circuit means connected to said speed sensor, setting circuit means for applying a standard level to said comparing circuit means for comparing the output of said speed sensor with the standard level, control circuit means for producing a pair of output signals for a time period in dependency on the output of said comparing circuit means, driving circuit means for driving said electro-mechanical actuator for increasing and decreasing said open state of said throttle valve in dependency on said output of said control circuit means, said control circuit means comprises a clock pulse generating circuit, a counter for counting the clock pulses, a logic circuit connected to said comparing circuit means and to said counter, and gate means, which are so arranged that said gate means are opened for a time period in dependency on the output of said comparing circuit means.

2. A system for regulating the engine speed of an internal combustion engine having a carburetor and a throttle valve in said carburetor, comprising:

an electro-mechanical actuator for maintaining said throttle valve to an open state, a speed sensor for detecting the speed of said engine, comparing circuit means connected to said speed sensor, setting circuit means for applying a standard level to said comparing circuit means for comparing the output of said speed sensor with the standard level, control circuit means for producing a pair of output signals for a time period in dependency on the output of said comparing circuit means, driving circuit means for driving said electro-mechanical actuator for increasing and decreasing said open state of said throttle valve in dependency on said output of said control circuit means, starting circuit means which is connected to an ignition switch of the engine and to said driving circuit means and is adapted to produce an output for actuating said actuator for increasing said throttle valve open state for a predetermined time upon closing of said ignition switch and to produce another output for decreasing said throttle valve open state for a predetermined time upon opening of said ignition switch so as to separate said actuator from a device of said throttle valve.

3. A system for regulating the engine speed of an internal combustion engine having a carburetor and a throttle valve in said carburetor, comprising:

an electro-mechanical actuator for maintaining said throttle valve to an open state, a speed sensor for detecting the speed of said engine, comparing circuit means connected to said speed sensor, setting circuit means for applying a standard level to said comparing circuit means for comparing the output of said speed sensor with the standard level, control circuit means for producing a pair of output signals for a time period in dependency on the output of said comparing circuit means, driving circuit means for driving said electro-mechanical actuator for increasing and decreasing said open state of said throttle valve in dependency on said output of said control circuit means, car speed detecting circuit means for producing an output when the car speed exceeds a predetermined level, contact switch means for detecting the separation of said actuator means from a device of said throttle valve, dash pot circuit means operable to produce an output for increasing the throttle valve open state for a predetermined time when the engine speed exceeds a predetermined level and said contact switch means detects the separation and to produce an output for slowly decreasing the throttle valve open state when said contact switch means detects the contact.

4. A system for regulating the engine speed of an internal combustion engine according to claim 3 further comprising throttle opener control circuit means operable to produce an output for increasing the throttle valve open state for a predetermined time when the engine speed exceeds a predetermined level which is higher than the level of said dash pot circuit means and to produce an output for decreasing the throttle valve open state when the engine speed decreases below the predetermined level.

5. In a system for regulating the engine speed of an internal combustion engine having a carburetor and a throttle valve in said carburetor, an electro-mechanical actuator means for maintaining said throttle valve in an open state, a speed sensor means for measuring the speed of said engine, a comparing circuit means for comparing the output of said speed sensor means with a reference value and for producing signals in dependency on the comparison, the improvement comprising:

a clock pulse generating circuit means for producing a clock pulse train, a counter means connected to an output of said clock pulse generating circuit for counting clock pulses of the clock pulse train, an A/D converter means for producing digital signals dependent on the output signal of said speed sensor means, a logic circuit means connected to outputs of said counter means and said A/D converter means for producing a pair of outputs for a time period determined by said digital signals, gate means electrically connected to the outputs of said comparing circuit means and of said logic circuit means so as to be opened for a time period dependent on the output of said logic circuit means, and a driving circuit means connected to the output of said gate means for driving said electro-mechanical actuator means for increasing and decreasing said open state of said throttle valve in dependency on the output of said gate means.

6. The system as set forth in claim 5, further comprising:

starting circuit means which is connected to an ignition switch of the engine and to said driving circuit means and is adapted to produce an output for actuating said actuator means for increasing said throttle valve open state for a predetermined time upon closing of said ignition switch and to produce another output for decreasing said throttle valve open state for a predetermined time upon opening of said ignition switch so as to separate said actuator means from a device of said throttle valve.

7. The system as set forth in claim 5, further comprising:

car speed detecting circuit means for producing an output when the car speed exceeds a predetermined level, contact switch means for detecting the separation of said actuator means from a device of said throttle valve, dash pot circuit means operable to produce an output for increasing the throttle valve open state for a predetermined time when the engine speed exceeds a predetermined level and said contact switch means detects the separation and to produce an output for slowly decreasing the throttle valve open state when said contact switch means detects the contact.

8. The system for regulating the engine speed of an internal combustion engine as set forth in claim 5, further comprising:

means for changing said reference value for increasing the throttle valve open state when an air-conditioner provided on a car is operated.

* * * * *

UNITED STATES PATENT AND TRADEMARK OFFICE

CERTIFICATE OF CORRECTION

PATENT NO. : 4,367,708

DATED : January 11, 1983

INVENTOR(S) : Hiroyuki Nakamura et al

It is certified that error appears in the above-identified patent and that said Letters Patent are hereby corrected as shown below:

Column 6, (claim 4) Line 13 after "3" insert --or 5--

Signed and Sealed this

*Twelfth* Day of *April 1983*

[SEAL]

*Attest:*

GERALD J. MOSSINGHOFF

*Attesting Officer*

*Commissioner of Patents and Trademarks*